US011433975B2

(12) United States Patent
Radicioni et al.

(10) Patent No.: US 11,433,975 B2
(45) Date of Patent: Sep. 6, 2022

(54) SYSTEM AND METHOD FOR TEMPORARILY CONNECTING AN UNDERWATER STATION AND A SURFACE FACILITY

(71) Applicant: SAIPEM S.p.A., San Donato Milanese (IT)

(72) Inventors: Alessandro Radicioni, San Donato Milanese (IT); Alessandro Filippi, San Donato Milanese (IT); Giovanni Moreschi, San Donato Milanese (IT)

(73) Assignee: SAIPEM S.P.A., San Donato Milanese (IT)

( * ) Notice: Subject to any disclaimer, the term of this patent is extended or adjusted under 35 U.S.C. 154(b) by 117 days.

(21) Appl. No.: 16/963,740

(22) PCT Filed: Dec. 7, 2018

(86) PCT No.: PCT/IB2018/059779
§ 371 (c)(1),
(2) Date: Jul. 21, 2020

(87) PCT Pub. No.: WO2019/145771
PCT Pub. Date: Aug. 1, 2019

(65) Prior Publication Data

US 2021/0094657 A1 Apr. 1, 2021

(30) Foreign Application Priority Data

Jan. 29, 2018 (IT) ..... 102018000002120

(51) Int. Cl.
*B63B 22/02* (2006.01)
*B63B 21/50* (2006.01)
(Continued)

(52) U.S. Cl.
CPC ..... *B63B 22/021* (2013.01); *B63B 21/508* (2013.01); *B63B 27/24* (2013.01); *B63B 25/02* (2013.01); *B63B 2021/505* (2013.01)

(58) Field of Classification Search
CPC ..... B63B 22/02; B63B 22/021; B63B 22/04; B63B 25/02; B63B 25/08; B63B 21/50;
(Continued)

(56) References Cited

U.S. PATENT DOCUMENTS 5,944,448 A 8/1999 Williams
7,690,434 B2 * 4/2010 Baross ..... B63B 21/507 441/5
(Continued)

FOREIGN PATENT DOCUMENTS

EP 3 054 083 8/2016
EP 3 253 945 12/2017
(Continued)

OTHER PUBLICATIONS

Notification Concerning Submission, Obtention or Transmittal of Priority Document for International Application No. PCT/IB2018/059779 dated Mar. 22, 2019.
(Continued)

*Primary Examiner* — Daniel V Venne
(74) *Attorney, Agent, or Firm* — Neal, Gerber & Eisenberg LLP

(57) ABSTRACT

A system for temporarily connecting an underwater station arranged on the bed of a body of water and a surface facility has an elongated conducting member with one end connected to the underwater station and one free end selectively and temporarily connectable to the surface facility; a marker buoy; and a cable connected to the free end of the elongated conducting member and to the marker buoy to quickly recover the free end of the elongated conductor element
(Continued)

when it is necessary to connect the underwater station via the elongated conducting member to the surface facility.

19 Claims, 6 Drawing Sheets

(51) Int. Cl.
*B63B 27/24* (2006.01)
*B63B 25/02* (2006.01)

(58) Field of Classification Search
CPC ..... B63B 21/505; B63B 21/508; B63B 2021/505; B63B 27/00; B63B 27/24
USPC ..... 441/3, 4, 5, 6
See application file for complete search history.

(56) References Cited

U.S. PATENT DOCUMENTS

| | | | | |
|---|---|---|---|---|
| 8,491,350 | B2 * | 7/2013 | Al-Sharif | B63B 22/023 441/5 |
| 9,470,365 | B1 | 10/2016 | Atkinson et al. | |
| 2014/0301790 | A1 | 10/2014 | Chitwood | |

FOREIGN PATENT DOCUMENTS

| | | |
|---|---|---|
| GB | 2 350 342 | 11/2000 |
| WO | WO 2012/066031 | 5/2012 |
| WO | WO 2015/026778 | 2/2015 |

OTHER PUBLICATIONS

International Search Report and Written Opinion for International Application No. PCT/IB2018/059779 dated Feb. 27, 2019.
PCT Demand for International Preliminary Examination and Reply to International Search Report and the associated Written Opinion for International Application No. PCT/IB2018/059779 dated Oct. 30, 2019.
Notification of Receipt of Demand by Competent International Preliminary Examining Authority (Form PCT/IPEA/402) for International Application No. PCT/IB2018/059779 dated Nov. 6, 2019.
Second Written Opinion for International Application No. PCT/IB2018/059779 dated Dec. 10, 2019.
Reply to the Second Written Opinion for International Application No. PCT/IB2018/059779 dated Feb. 10, 2020.
Notification of Transmittal of the International Preliminary Report on Patentability (Form PCT/IPEA/416) for International Application No. PCT/IB2018/059779 dated May 27, 2020.

* cited by examiner

SYSTEM AND METHOD FOR TEMPORARILY CONNECTING AN UNDERWATER STATION AND A SURFACE FACILITY

PRIORITY CLAIM

This application is a national stage application of PCT/IB2018/059779, filed on Dec. 7, 2018, which claims the benefit of and priority to Italian Patent Application No. 102018000002120, filed on Jan. 29, 2018, the entire contents of which are each incorporated by reference herein.

TECHNICAL FIELD

The present disclosure concerns a system for temporarily connecting an underwater station and a surface facility.

BACKGROUND

In the oil & gas sector, the use of underwater stations for processing hydrocarbons is becoming more widespread. It is thus necessary to temporarily connect an underwater station and a surface facility to transfer service fluids and/or energy and/or signals between the underwater station and the surface facility.

With specific reference to an underwater station used for extracting, transporting and processing hydrocarbons, the management of a multiphase petrochemical fluid transport system requires use of a plurality of service fluids or "additives" to prevent and mitigate the onset of problems such as the deposit of asphaltenes, waxes, inorganic salts, or hydrates which can lead to the transport system becoming critical or being put out of service. The occurrence of these problems depends on the characteristics of the fluid extracted from the well and on the temperature and pressure conditions which occur in the system. In some cases, it is necessary to inject biocides to minimize the proliferation of anaerobic bacteria which produce $H_2S$ and thus cause corrosion both in the transport system and in the water injection systems which are used to stimulate and increase the production of the deposit. To this end, underwater stations also comprise underwater storage tanks for service fluids and stations for pumping and regulating the flow of service fluids.

U.S. Published Patent Application No. 2014/0301790 describes a method of refilling an underwater tank performed by a surface facility equipped with pumps, underwater storage tanks, a control unit, an umbilical, and a winch to selectively reel out and reel in the umbilical whenever it is necessary to refill the underwater storage tank. The method requires the use of a ROV to control, position and connect the free end of the umbilical to the storage tank. The surface facility must further be equipped with a tensioning system and a crane which makes its use particularly relatively expensive.

U.S. Pat. No. 9,470,365 describes a method of supply using a surface facility which can be connected to a surface buoy (CALM buoy), which is anchored to the bed of the body of water and a riser which connects to a collector arranged on the bed of the body of water and connected to the underwater tank which, in turn, is connected to an underwater pumping module and to the operating lines. The surface buoy is particularly relatively expensive, requires a plurality of mooring lines and is subject to weather and sea conditions and, as a result, subjects the riser to fatigue. This system is relatively difficult to implement, all the more so if the water is relatively deep.

The increasingly widespread use of underwater stations for the extraction, transport and processing of hydrocarbons, sometimes also at relatively great depths and/or at relatively great distances from surface facilities, accentuates the problems related to the connection between the underwater station and the surface. This connection is often not only related to the supply of chemicals, but also to the supply and recovery of other service fluids, the transmission of energy and the exchange of signals between the underwater station and the surface.

In addition, with specific reference to the issue of the supply of service fluids to an underwater station, there is a need to limit the period of storage of service fluids underwater to reduce the risk of their deterioration. As a result, it is necessary to implement small tanks, which require frequent replenishment. However, certain known methods of temporarily connecting an underwater station are relatively too expensive and/or require equipped support vessels, which are not always readily available when needed.

PCT Patent Application No. WO 2012/066,031 A1 discloses a transfer system comprising a subsea installation, which is fixed relative to the seabed, and at least one transfer element for transfer of at least one fluid and/or electrical signals and/or electric current between the subsea installation and a floating arrangement, which transfer element is arranged for connection to the subsea installation at a first end and comprises connecting means for connecting to the floating arrangement at its free end. The transfer system further comprises a buoyancy element, which is anchored to the seabed and is provided with at least one through hole in the vertical direction, and the transfer element extends through the one hole in the buoyancy element and is movable in both directions through the hole.

The connection between the transfer element and subsea installation is however a critical link of the system.

SUMMARY

The object of the present disclosure is to provide a system for temporarily connecting an underwater station and a surface facility, which is both relatively cost effective and efficient and mitigates certain of the drawbacks of certain of the known art.

In accordance with the present disclosure, a system is provided for temporarily connecting an underwater station to a surface facility, the system comprising:

- an underwater station comprising at least one tank configured to contain service fluids;
- a surface facility;
- an elongated conducting member having one end connected to the underwater station and a free end selectively and temporarily connectable to the surface facility;
- a marker buoy;
- a cable connected to the free end of the elongated conducting member and to the marker buoy; and
- an anchoring device for connecting the elongated conducting member at the end connected to said tank is connected to the bed of the body of water.

In accordance with the system, which is the object of the present disclosure, the recovery of the elongated conductor element is relatively fast and the surface facility does not require particularly relatively expensive equipment to carry out the required operations. Furthermore, in its resting configuration, the elongated conductor element is not exposed to the variable surface sea and weather conditions. The anchoring device prevents the elongated conducting member from potentially damaging movements.

In accordance with an embodiment of the present disclosure, the system comprises a depth buoy slidably coupled to the elongated conducting member and configured to keep the free end of the elongated conducting member at the depth buoy. It should be appreciated that it is possible to choose the depth at which to position the depth buoy according to the typical characteristics of the body of water in which the system is intended to operate.

Recovery of the elongated conductor element is thus particularly relatively easy even when the underwater station is in relative deep water.

In particular, the system comprises one single mooring line to connect the depth buoy to the bed of the body of water.

It should be appreciated that the system of the present disclosure is relatively cost effective and, at the same time, makes it possible for the depth buoy to assume different operating configurations depending on the position of the elongated conductor element with respect to the depth buoy. Indeed, the forces acting on the depth buoy vary depending on the position of the elongated conductor element with respect to the depth buoy. The mobility of the depth buoy makes it possible to find equilibrium points for each position taken by the elongated conductor element, which minimize the forces exchanged between the depth buoy and the elongated conductor element based on the principle that a labile system assumes the configuration which minimizes the forces exchanged.

In particular, the depth buoy comprises a slidably coupled sleeve which slides around the elongated conducting member, the free end of the elongated conducting member comprising a head configured to be connected to pipes, electrical cables, fibre optic cables, etc. of the surface facility. In other words, the head is configured to facilitate connections on the support ship or support barge or support vessel.

In addition, the head is larger than the minimum diameter of the sleeve so that the sleeve acts as a support for the head. This configuration prevents the elongated conducting member from slipping out from the depth buoy.

In particular, the sleeve has a flared end. This is the upper end of the depth buoy, which, when the elongated conducting member is connected to the surface facility, prevents the elongated conducting member from taking on excessive curvatures, bending, and being damaged. Specifically, the flared end has a radius of curvature greater than the minimum permissible radius of curvature of the elongated conducting member to protect the integrity of the latter. A similar flaring is also provided on the hooking structure of the surface facility.

In particular, the sleeve has a slanted end. Specifically, the slanted end is arranged at the opposite end to the flared end and has the function of deflecting the elongated conducting member in a particular direction in a controlled manner. That is, the slant is determined depending on the configuration that the system assumes in its resting configuration, with the head resting on the buoy, and in its operational configuration, with the head connected to the surface facility.

In particular, the depth buoy comprises floating modules arranged around the sleeve, which relatively simplify the buoy from the perspective of construction and make it possible to implement a modular configuration depending on the vertical thrust required at the depth buoy. In this case, the buoyancy modules are distributed between the flared and the slanted ends.

The anchoring device prevents the elongated conducting member from potentially damaging movements.

In accordance with the present disclosure, the anchoring device comprises a double flared sleeve fixedly fitted around the elongated conducting member; an anchoring cable connected to the double flared sleeve; and a plurality of buoyancy modules fixed to the elongated conducting member upstream of the double flared sleeve.

In practice, the anchoring device is a dynamic attachment, which both limits excursions of the elongated conducting member near the landing point and enables the elongated conducting member to assume different configurations preventing drift phenomena and excessive curvatures of the elongated conducting member. The anchoring device thus prevents the elongated conducting member from taking on configurations prejudicial to its integrity without applying excessive forces to the elongated conducting member, which, in turn, could compromise its integrity.

In particular, the system comprises a surface facility equipped with a lifting device configured to lift the head of the elongated conducting member above the bed of the body of water. The weight to be lifted by the crane is relatively light and thus neither relatively large surface facilities nor indeed relatively heavy lifting devices are required.

In particular, the support ship or support barge or support vessel comprises a hooking structure for hooking the free end of the elongated conducting member onto an edge of the support ship or support barge or support vessel.

The elongated conducting member is thus connected to the surface facility, which is equipped to supply the underwater station without the need to bend or fold the elongated conducting member at the surface facility bridge.

A further object of the present disclosure is to provide a method to temporarily connect an underwater station to a surface facility and to mitigate certain of the drawbacks of certain of the known art.

In accordance with the present disclosure, a method is provided for temporarily connecting an underwater station and a surface facility, the method comprising the steps of:

- recovering a marker buoy connected by a cable to the free end of an elongated conducting member permanently connected to the underwater station by the surface facility;
- recovering the free end of the elongated conducting member by the surface facility;
- securing the free end of the elongated conducting member to the surface facility;
- transferring fluids to at least one tank of the underwater station from the surface facility through the elongated conducting member; and
- connecting the elongated conducting member at the end connected to the underwater station to the bed of the body of water by an anchoring device.

It should be appreciated that in accordance with the present disclosure, discontinuous supply of the underwater station is particularly relatively simple and cost-effective, particularly in relatively shallow waters.

In relatively deep waters, the depth buoy enables the free end of the elongated conducting member to be kept near the surface of the body of water and, in any case, at a depth which does not expose the depth buoy to the variable marine weather conditions of the surface layer of the body of water. This solution makes it possible to reduce the recovery time of the free end of the elongated conducting member.

Consequently, the constraint imposed on the elongated conducting member by the depth buoy is a dynamic constraint. The depth buoy can assume different equilibrium operational configurations depending on the forces exchanged between the depth buoy and the elongated conducting member. Each equilibrium position minimizes the forces exchanged between the elongated conducting member and the depth buoy.

BRIEF DESCRIPTION OF THE FIGURES

Further characteristics and benefits of the present disclosure will be apparent from the following description of a non-limiting example of an embodiment of it, with reference to the Figures of the attached drawings, wherein.

DETAILED DESCRIPTION

Figure 1:
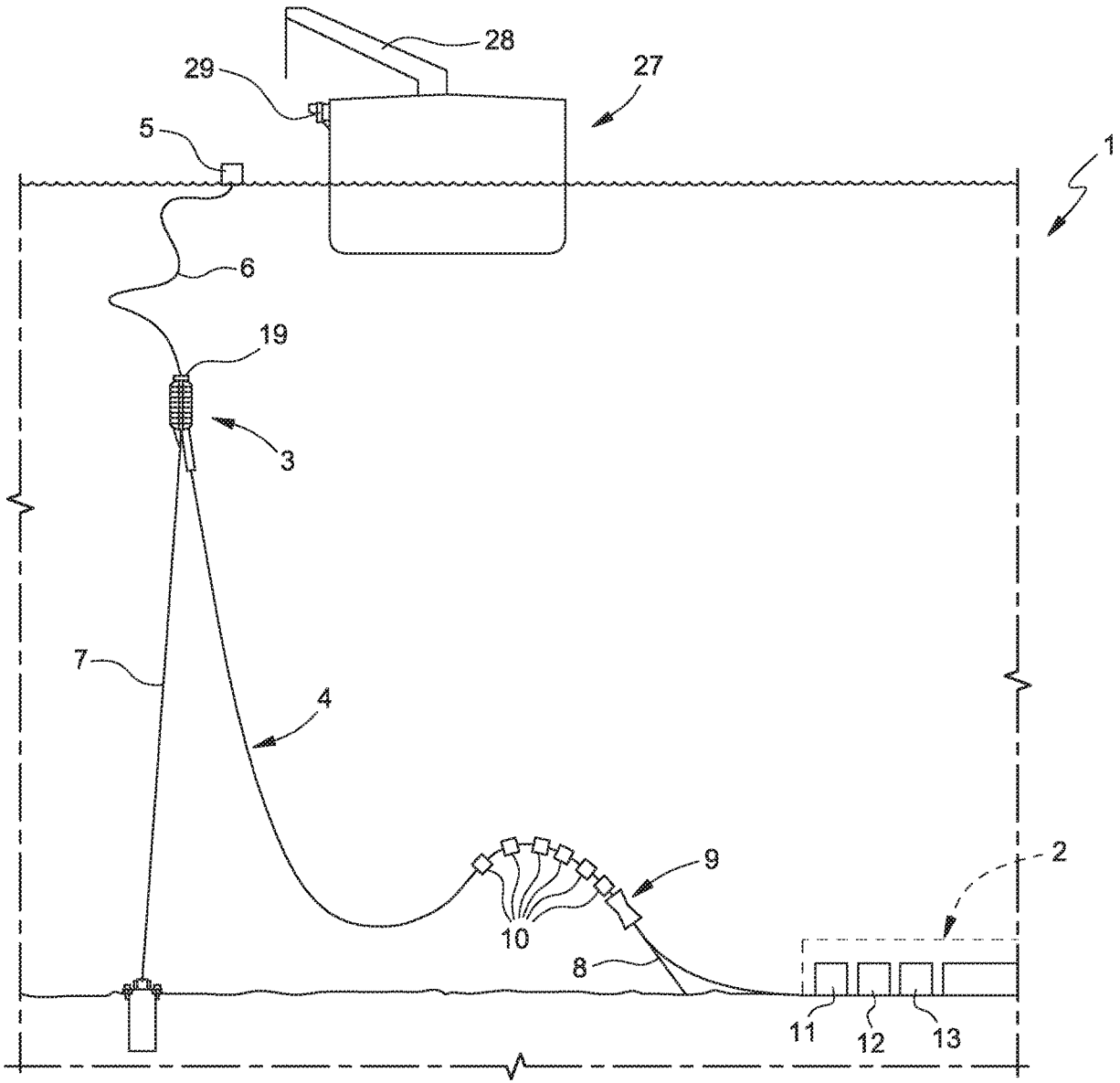
FIG. 1 is a schematic view, with parts removed for clarity, of a system for temporarily connecting an underwater station and a surface facility in accordance with the present disclosure.

With reference to FIG. 1, a system 1 configured to temporarily connect an underwater station 2 and a surface facility 27 is shown in its entirety; in this case, the surface facility 27 is a ship 27 comprising a lifting device 28 and a hooking structure 29. While, the surface facility 27 shown is a ship, it should be appreciated that the surface facility could be a relatively small barge or a relatively small vessel.

The system 1 comprises a depth buoy 3; an elongated conducting member 4 permanently connected to the underwater station 2; a marker buoy 5; and a cable 6 connected to the free end of the elongated conducting member 4 and to the marker buoy 5. The depth buoy 3 is anchored to the bed of the body of water by a single mooring line 7. In FIG. 1, the mooring line 7 is anchored to the bed of the body of water by appropriate foundations, for example gravity foundations, on piles or suction piles, depending on the type of soil. In this case, the position of the elongated conducting member 4 is restricted to being near the underwater station 2 to limit movements of the elongated conducting member 4 to near the landing point of the elongated conducting member 4. Control of the position of the elongated conducting member 4 is carried out by a control device which comprises a cable 8, which is anchored to the bed of the body of water; a sleeve 9 which is flared at opposite ends, and is connected to the cable 8; and a series of buoyancy modules 10 which provide upward thrust to the elongated conducting member 4 upstream of the sleeve 9. The elongated conducting member 4 is housed in a sleeve 9 and is anchored to the sleeve 9 so that the elongated conducting member cannot slide.

The underwater station 2 is an underwater station configured to process hydrocarbons, of the type described in the EP Patent Application No. 3,054,083 and EP Patent Application No. 3,253,945 belonging to the applicant. In this case, the underwater station 2 comprises a plurality of tanks 11, 12, and 13 configured to contain chemicals or other service fluids. The tanks 11, 12 and 13 are storage tanks and are configured to operate in a body of water even at relatively great depths.

Figure 2:
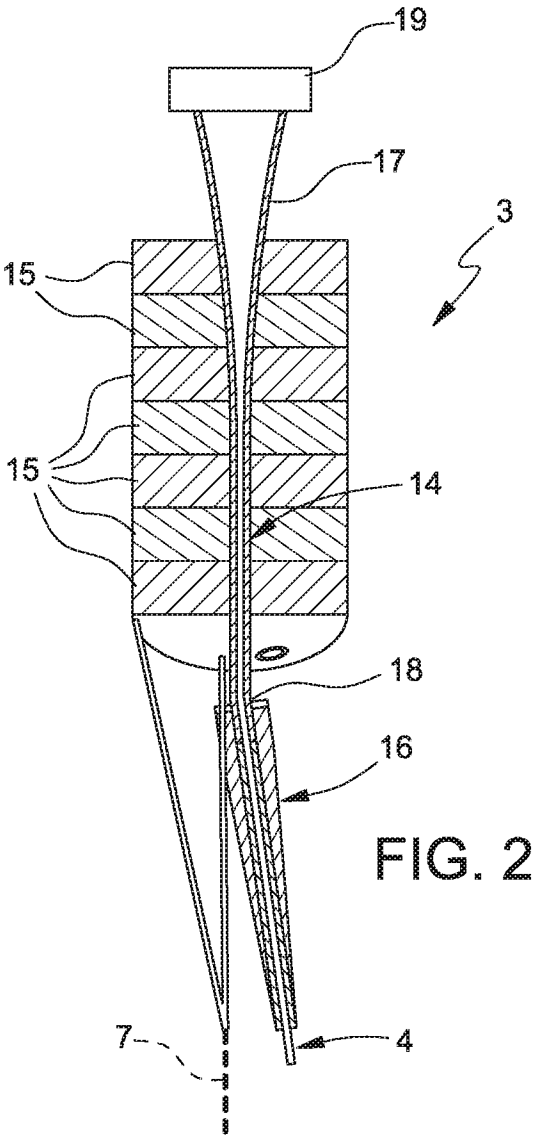
FIG. 2 is a longitudinal section view, with parts removed for clarity, of a detail of the system of FIG. 1.

With reference to FIG. 2, the depth buoy 3 comprises a sleeve 14 with a flared end 17; a plurality of buoyancy modules 15 arranged around the sleeve 14 and attached to the sleeve 14; and a stiffening element 16, which is arranged around the elongated conducting member 4 and is attached to the sleeve 14 at the opposite end to the flared end 17.

In more detail, the sleeve 14 has a slanted end 18 which is slanted with respect to the rest of the sleeve 14. The slanted end 18 is arranged at the opposite end to the flared end 17. The stiffening element 16 is attached to the slanted end 18. The mooring line 7 is attached to the lower part of the sleeve 14 and defines, together with the depth buoy 3 and the elongated conducting member 4, a system which has different equilibrium points depending on the position of the elongated conducting member 4 with respect to the depth buoy 3.

The diameter of the elongated conducting member 4, which depends on the number and characteristics of the necessary functions which may vary from project to project, is smaller than the minimum diameter of the sleeve 14 so as to enable the elongated conducting member 4 to slide relatively easily inside the depth buoy 3 and has a head 19 with a diameter, or in general transverse dimensions, greater than the maximum diameter of the sleeve 14 so as to prevent removal of the elongated conducting member 4 from the depth buoy 3.

In the present disclosure, the term "elongated conducting member" means a pipe for conducting fluids or a cable for conducting energy or signals or a bundle of pipes and/or cables for conducting fluids and/or energy and/or signals or an umbilical.

Figure 3:
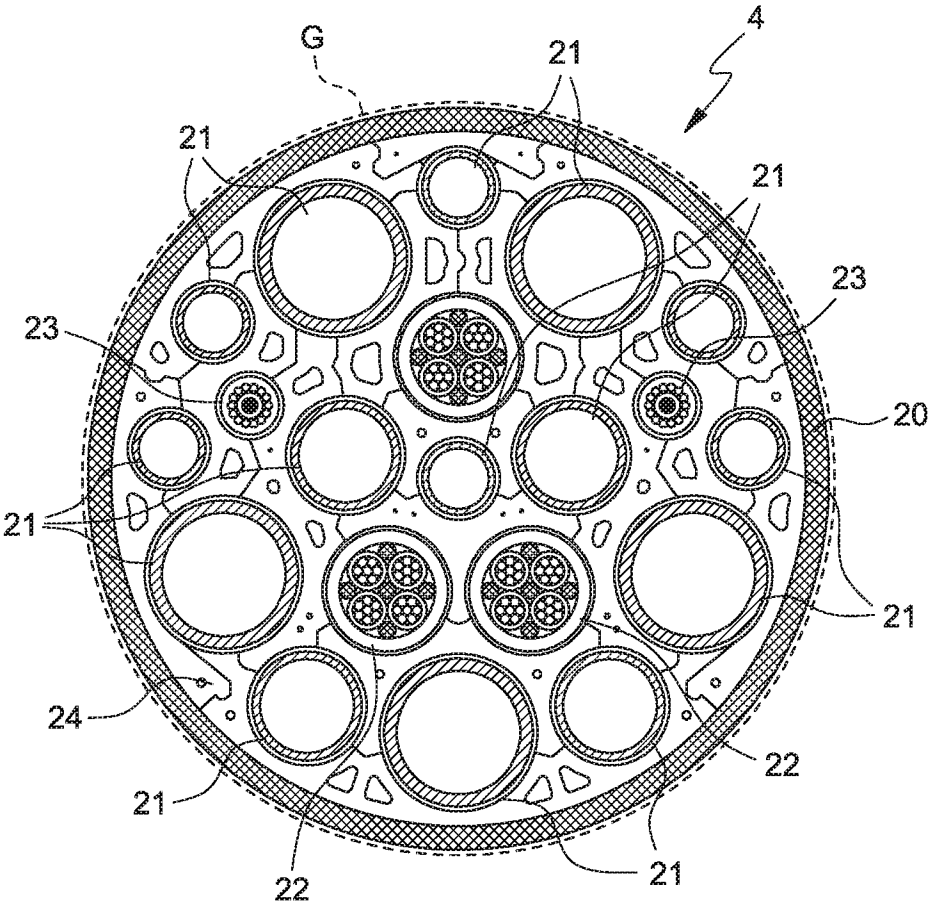
FIG. 3 is a section view, in enlarged scale and with parts removed for clarity, of an element of the system element of FIG. 1.

With reference to FIG. 3, the elongated conducting member 4 is shown as an umbilical and comprises a containment element 20; and a plurality of pipes 21, which are arranged inside the containment element 20 and are used to convey the respective service fluids, in this case, the respective chemicals or other service fluids. In sections wherein the elongated conducting member 4 slides relative to the depth buoy 3 and the sleeve 9, the containment element 20 is protected by a protective sheath G, which facilitates sliding of the elongated conducting member 4 in the depth buoy 3 and protects the containment element 20 from wear. In the case shown, the elongated conducting member 4 also comprises a plurality of electrical power cables 22 and electrical and/or fibre optic data cables 23, which are housed inside the containment element 20. The elongated conducting member 4 also comprises a filler 24 which has the function of spacing apart from each other the pipes 21 and the cables 22 and 23, and the pipes 21 and cables 22 and 23 from the inner face of the containment element 20. In variants not shown, the elongated conducting member 4 only comprises pipes configured to connect chemicals or other service fluids in the liquid state. In addition, where necessary, the containment element 20 of the elongated conducting member 4 is reinforced to meet structural requirements associated with installation and operating loads.

Figure 4:
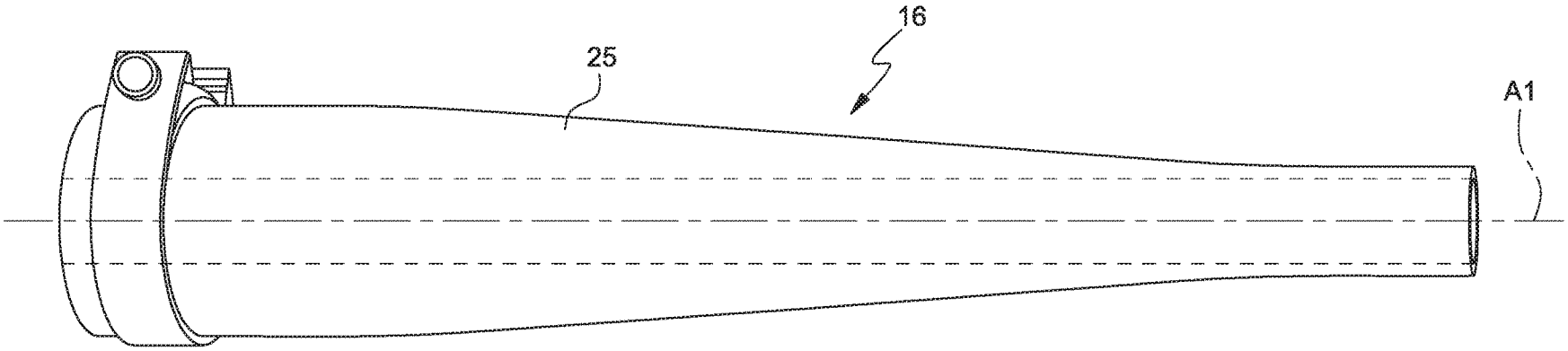
FIGS. 4 and 5 show two lateral views, with parts removed for clarity, of two respective components of the system which is the object of the present disclosure.

With reference to FIG. 4, the stiffening element 16 is sleeve-shaped, extends around an axis A1, is mainly made of polymer material, and has a through-hole in the axis A1 with a substantially constant section; and a cylindrical wall 25 with a progressively increasing section along the axis A1 from left to right in FIG. 4 so as to have a differentiated flexibility along the axis A1. In practice, the flexibility of the stiffening element 16 increases along the A1 axis from right to left in FIG. 4.

Figure 5:
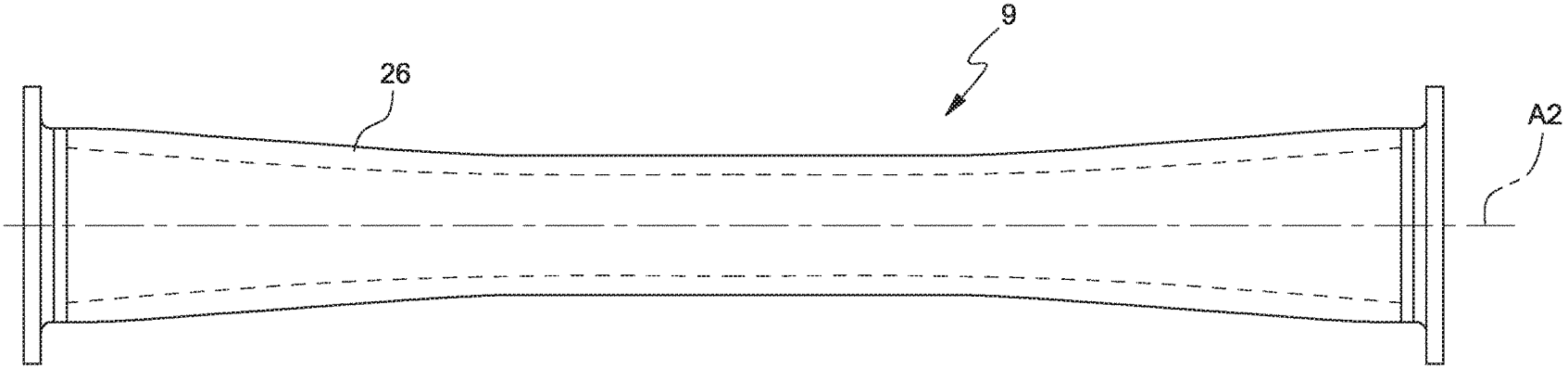

With reference to FIG. 5, the sleeve 9 extends along the axis A2, has two flared ends and a wall 26 of substantially constant thickness.

Figure 7:
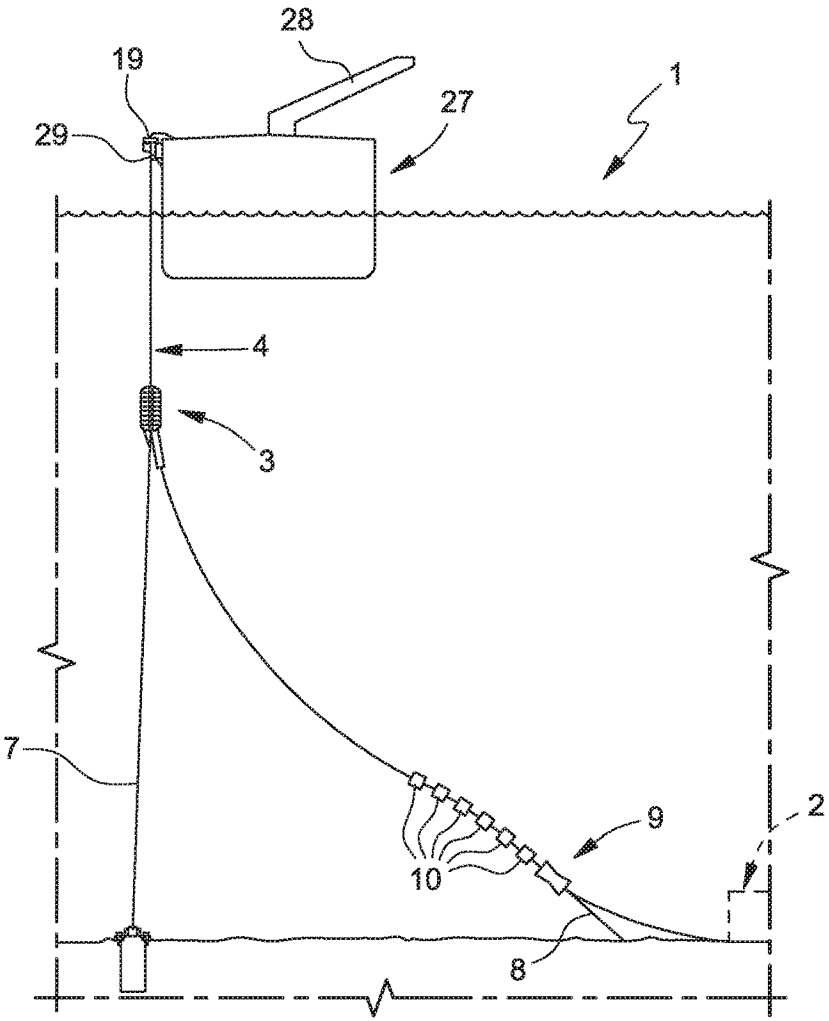
FIGS. 6 and 7 are side elevation views, with parts removed for clarity, of the system which is the object of the present disclosure during the step of recovering an elongated conducting member.
Figure 6:
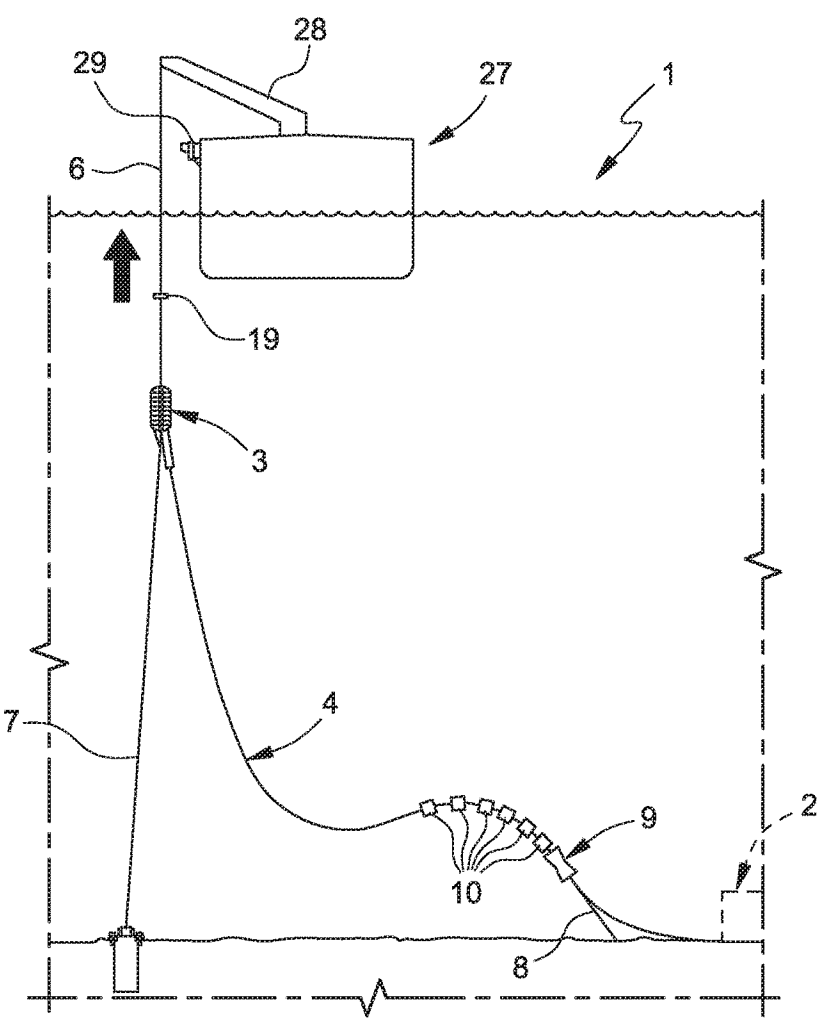

In use, the system 1 for temporarily connecting the underwater station 2 is generally arranged in the resting configuration shown in FIG. 1. When it is indicated that it is necessary to transfer service fluids and/or energy and/or signals between the underwater station 2 and a surface facility 27, the surface facility 27 reaches the position indicated by the marker buoy 5 as better shown in FIG. 1. The surface facility is equipped with a lifting device 28, which recovers the cable 6 and lifts the elongated conducting member 4, which runs through the depth buoy 3. The head 19 of the elongated conducting member 4 is attached to a hooking structure 29 arranged on an edge of the surface facility 27 as shown in FIG. 7. In the operating configuration of FIG. 7, the head 19 of the elongated conducting member 4 is, for example, connected to a pumping device for chemicals or other service fluids in the liquid state arranged on board the surface facility 27 and/or to a generator or to a battery and/or to a device configured to exchange signals with the underwater station 2.

Once the transfer is complete, the surface facility 27 and the lifting device 28 reposition the elongated conducting member 4 and the marker buoy 5 into the resting configuration shown in FIG. 1.

The system 1 described with reference to FIGS. 1 to 7 is particularly beneficial for temporarily connecting a surface facility 27 and the underwater station 2 lying on the bed of a body of water in relatively deep water.

Figure 9:
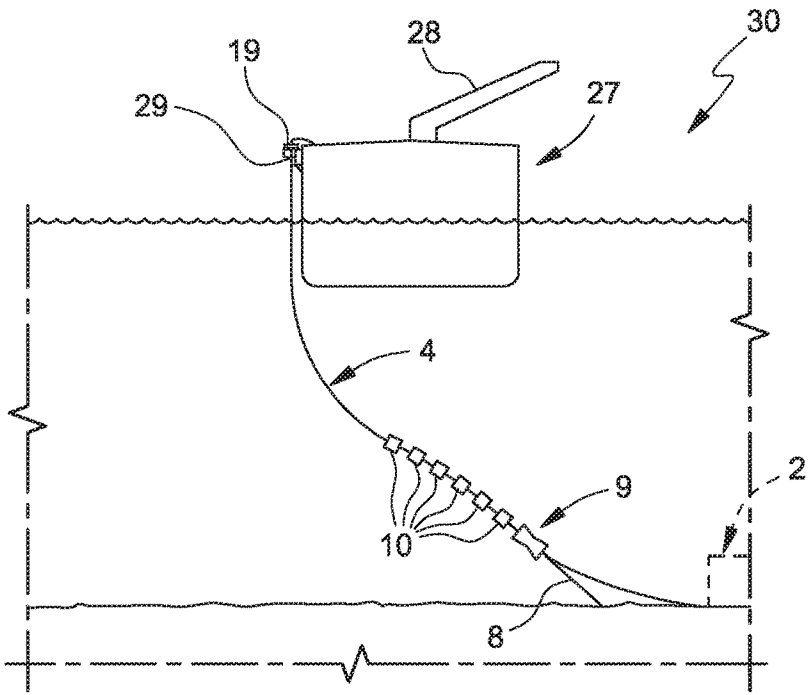
FIGS. 8 and 9 are lateral elevation views, with parts removed for clarity, of an alternative embodiment of the system which is the object of the present disclosure.
Figure 8:
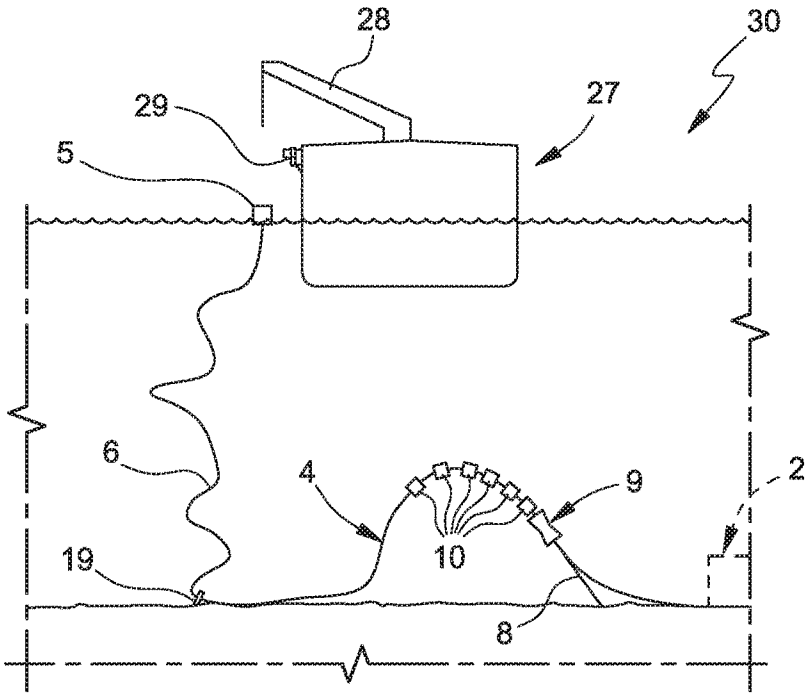

If however the underwater station 2 is positioned on the bed of a body of water in relatively shallow waters it is convenient to use the system 30 shown in FIGS. 8 and 9. The system 30 differs from the system 1 described in FIGS. 1 to 7 in that the depth buoy 3 and its mooring line 7 are omitted and the head 19 of the elongated conducting member 4 rests on the bed of the body of water.

In a further variant of the system 30 not shown in FIGS. 8 and 9, the cable 8, the sleeve 9 and the buoyancy modules 10 are omitted and, in the resting configuration, the elongated conducting member 4 is entirely supported on the bed of the body of water.

Figure 11:
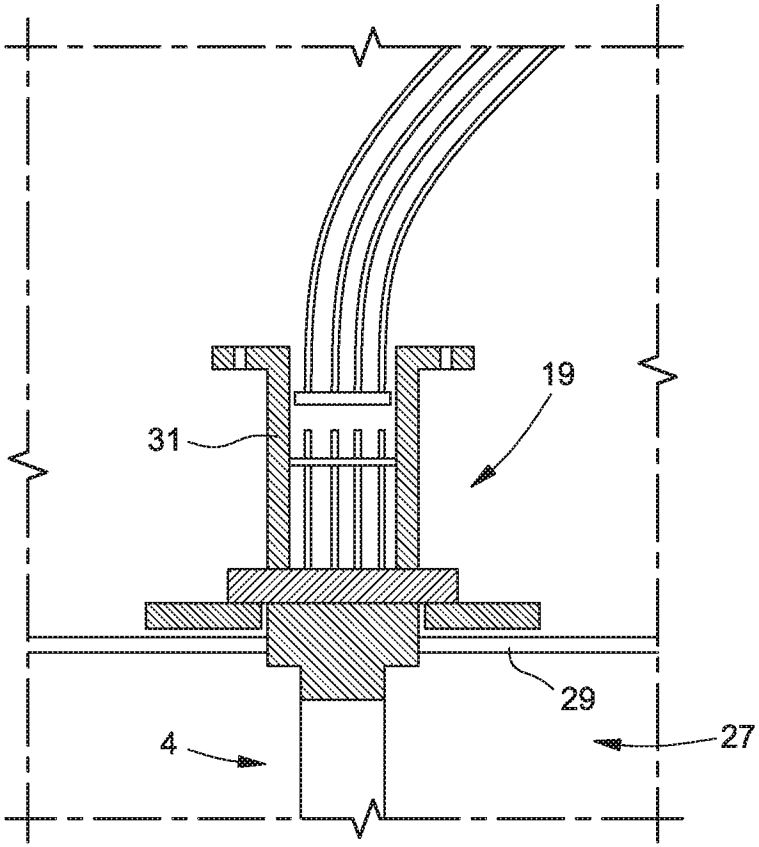
FIGS. 10 and 11 are two lateral views, with parts removed for clarity and parts in section, of two respective components of the system, which is the object of the present disclosure.
Figure 10:
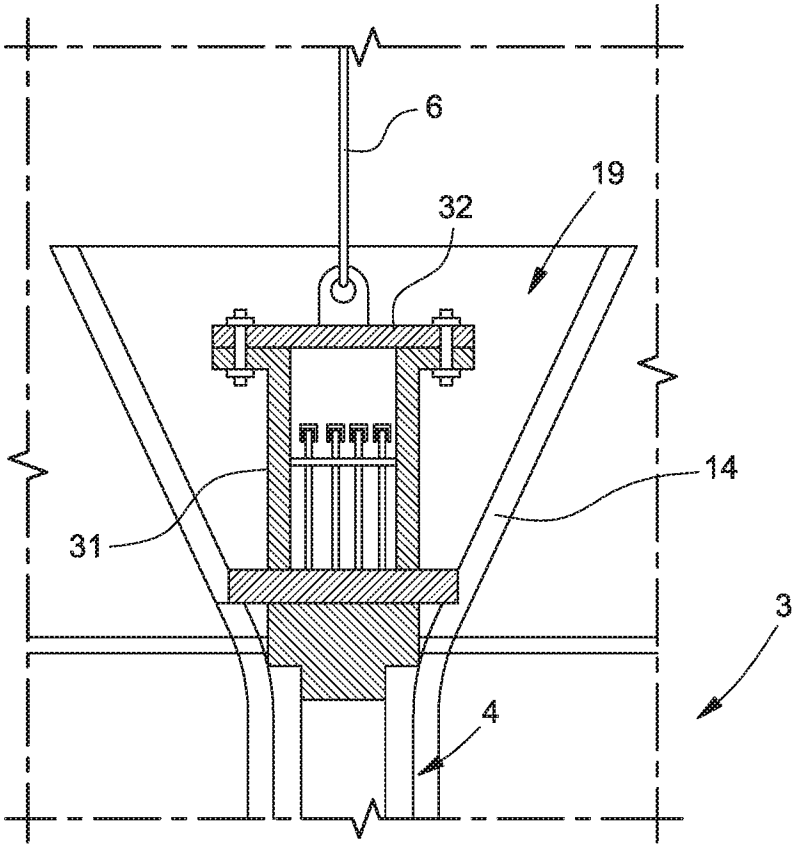

With reference to FIGS. 10 and 11, the head 19 of the elongated conducting member 4 comprises an end structure 31, which is integral with the elongated conducting member 4; and a flange or mechanical connector 32 (FIG. 10), which is configured to be coupled to the end structure 31 and the cable 6. When the end structure 31 and the corresponding flange 32 are coupled together, they define a closed, generally hermetic, compartment inside which the free ends of the pipes and/or cables converge. These free ends are suitably sealed and protected.

In the resting configuration shown in FIG. 10, the end structure 31 and the corresponding flange 32 are housed within the flared part of the sleeve 14 while, in the operating configuration of FIG. 11, the end structure 31 without a flange 32 is supported by the hooking structure 29 of the surface facility 27 and the pipes and/or cables are connected with the respective pipes and/or cables of the surface facility 27.

It is clear that the present disclosure comprises further variants not explicitly described, without however departing from the protective scope of the following Claims. Accordingly, various changes and modifications to the presently disclosed embodiments will be apparent to those skilled in the art.

The invention claimed is:

1. A system comprising:

an underwater station comprising a tank configured to contain a service fluid;

a surface facility;

an elongated conducting member having one end connected to the tank of the underwater station and a free end selectively connectable to the surface facility;

a cable having one end connectable to the free end of the elongated conducting member and another end connectable to a marker buoy; and an anchoring device configured to connect a portion of the elongated conducting member adjacent to the end connected to the tank of the underwater station to a bed of a body of water.

2. The system of claim 1, further comprising a depth buoy slidably coupled to the elongated conducting member and configured to temporarily keep the free end of the elongated conducting member at the depth buoy.

3. The system of claim 2, further comprising a mooring line connecting the depth buoy to the bed of the body of water.

4. The system of claim 2, wherein:

the depth buoy comprises a sleeve slidably coupled around the elongated conducting member, and the free end of the elongated conductor member is integral with a head connectable to at least one of a pipe of the surface facility and an electrical cable of the surface facility.

5. The system of claim 4, wherein the sleeve defines a flared end.

6. The system of claim 4, wherein the sleeve is configured for supporting the head.

7. The system of claim 4, wherein the sleeve defines a slanted end.

8. The system of claim 4, wherein the depth buoy comprises a buoyancy module arranged around the sleeve.

9. The system of claim 4, wherein the head defines an end structure integral with the elongated conducting member and a flange configured to be coupled to the end structure and the cable.

10. The system of claim 1, wherein the anchoring device comprises:

a double flared sleeve fixedly fitted around the elongated conducting member;

an anchoring cable connected to the double flared sleeve; and a buoyancy module fixed to the elongated conducting member upstream of the double flared sleeve.

11. The system of claim 1, wherein the surface facility comprises a lifting device configured to lift the free end of the elongated conducting member above the body of water.

12. The system of claim 11, wherein the surface facility comprises a hooking structure configured to hook the free end of the elongated conducting member onto an edge of the surface facility.

13. A system comprising:

an elongated conducting member having one end connected to a tank of an underwater station and a free end selectively connectable to a surface facility;

a cable having one end connectable to the free end of the elongated conducting member and another end connectable to a marker buoy; and an anchoring device configured to connect a portion of the elongated conducting member adjacent to the end connected to the tank of the underwater station to a bed of a body of water.

14. The system of claim 13, further comprising a depth buoy slidably coupled to the elongated conducting member and configured to temporarily keep the free end of the elongated conducting member at the depth buoy.

15. The system of claim 14, wherein:

the depth buoy comprises a sleeve slidably coupled around the elongated conducting member, and the free end of the elongated conductor member is integral with a head connectable to at least one of a pipe of the surface facility and an electrical cable of the surface facility.

16. The system of claim 15, wherein the head defines an end structure integral with the elongated conducting member and a flange which is configured to be coupled to the end structure and the cable.

17. The system of claim 13, wherein the anchoring device comprises:

a double flared sleeve fixedly fitted around the elongated conducting member;

an anchoring cable connected to the double flared sleeve; and a buoyancy module fixed to the elongated conducting member upstream of the double flared sleeve.

18. A method for connecting an underwater station and a surface facility, the method comprising:

recovering, via the surface facility, a marker buoy connected by a cable to a free end of an elongated conducting member having another end connected to the underwater station, wherein a portion of the elongated conducting member adjacent to the end connected to the underwater station is connected, by an anchoring device, to a bed of a body of water;

recovering, via the surface facility, the free end of the elongated conducting member;

securing the free end of the elongated conducting member to the surface facility; and transferring fluid to a tank of the underwater station from the surface facility through the elongated conducting member.

19. The method of claim 18, wherein the other end of the elongated conducting member is permanently connected to the underwater station.

* * * * *